US007855345B2

(12) United States Patent
Stevens et al.

(10) Patent No.: US 7,855,345 B2
(45) Date of Patent: Dec. 21, 2010

(54) DIFFERENTIAL PRESSURE SWITCH

(75) Inventors: James E. Stevens, Elk Grove, IL (US); Geoffrey M. Stevens, Elk Grove, IL (US); Bill Irwin, Las Vegas, NV (US); Leung Wai Tat Raymond, Kowloon (HK)

(73) Assignee: Stevens Pump Company, Elk Grove, IL (US)

( * ) Notice: Subject to any disclaimer, the term of this patent is extended or adjusted under 35 U.S.C. 154(b) by 305 days.

(21) Appl. No.: 11/985,883

(22) Filed: Nov. 19, 2007

(65) Prior Publication Data

US 2009/0129940 A1 May 21, 2009

(51) Int. Cl.
*H01H 35/26* (2006.01)

(52) U.S. Cl. ..... 200/83 S

(58) Field of Classification Search ..... 200/83 S, 200/83 R, 83 P, 83 SA
See application file for complete search history.

(56) References Cited

U.S. PATENT DOCUMENTS

| | | | | |
|---|---|---|---|---|
| 2,844,678 | A | | 7/1958 | Nielsen |
| 3,800,205 | A | | 3/1974 | Zalar |
| 4,898,513 | A | | 2/1990 | Hon |
| 4,990,728 | A | * | 2/1991 | Joyce ..... 200/83 P |
| 5,136,129 | A | * | 8/1992 | Kaigler et al. ..... 200/83 R |
| 5,234,319 | A | | 8/1993 | Wilder |
| 5,495,079 | A | * | 2/1996 | Joyce ..... 200/81 R |
| 5,562,423 | A | | 10/1996 | Orth et al. |
| 5,622,477 | A | | 4/1997 | Orth et al. |
| 5,708,313 | A | | 1/1998 | Bowes et al. |
| 6,149,390 | A | | 11/2000 | Fisher et al. |
| 6,461,114 | B1 | | 10/2002 | Lin |
| 6,474,952 | B1 | | 11/2002 | Fisher et al. |
| 6,601,607 | B1 | | 8/2003 | Pratt |
| 6,737,597 | B1 | | 5/2004 | Galpchian |
| 2003/0049134 | A1 | | 3/2003 | Leighton et al. |
| 2006/0176000 | A1 | | 8/2006 | Schulman et al. |
| 2007/0098582 | A1 | | 5/2007 | Schulman |

FOREIGN PATENT DOCUMENTS

| | | |
|---|---|---|
| DE | 198 05 138 A1 | 12/1999 |
| GB | 2312950 A | 12/1997 |

* cited by examiner

*Primary Examiner*—Felix O Figueroa
(74) *Attorney, Agent, or Firm*—McDonald Hopkins LLC; Michael J. Femal

(57) ABSTRACT

The invention relates to a field adjustable pressure switch that incorporates a manually adjustable differential to set the pressure level for the trip point for the pressure switch used in conjunction with a submersible sump pump system requiring trip levels corresponding to the desired water level in the sump well for operation of the pump motor.

8 Claims, 6 Drawing Sheets

DIFFERENTIAL PRESSURE SWITCH

TECHNICAL FIELD

The invention relates to a pressure switch, and more particularly, to a pressure switch used in conjunction with a submersible sump pump system having an adjustable differential to set the pressure level value corresponding to the water level in the sump well for operation of the pump motor.

BACKGROUND OF THE INVENTION

Prior art submersible sump pumps generally have included a pressure sensitive electrical switch to turn on the sump pump motor to drain the sump well when a certain level of water is reached in a sump well. These electrical pressure switches generally consisted of a housing for the pneumatic and electrical components. Air pressure is received by the switch through a stem connection to a water column enclosure that receives water at one end and traps air at the other end that is directly connected to the stem intake of the pressure switch. Depending upon the construction of the stem intake end of the pressure switch, a number of prior art switch constructions allow moisture to leak into the switch causing problems with the electrical contacts and other components. The moisture is known to cause corrosion amongst the electrical components therein. Moreover, many of these pressure switches had a predetermined calibrated trip point that was set at the factory and if modified in the field resulted in inadvertent switch failures and erratic operations of the switch. Such erratic conditions for operation of the pressure switch are unsuitable for sump pump applications where improper operation can lead to flooding within building structures.

Although the prior art pressure switches are often made from a material having good electrical properties like phenolic for its housing, phenolic material generally has a serious drawback and that is the release of small amounts of ammonia captured during the phenolic molding process. Small releases of ammonia over a period of time can cause corrosion issues with the electrical contacts within the switch. So this also creates a problem for most pressure switches in sump pump applications.

The air sensitive diaphragm of the prior art pressure switches generally acts against a large spring captured within a spring cap on the switch. The spring cap setting for the trip point of the switch is generally set at the factory. This does not allow for any adjustment of the trip points for the pressure switch in the field. Often times, the operator or user of the sump pump system will desire actuation of the sump pump at different water levels within the sump well. Sump wells and the location of the submersible sump pumps therein are done in all different configurations so the ability to change the trip level for draining the water in the well may become an important factor in the usefulness of a particular pressure switch when used with a certain sump pump configuration. The typical reset point of most prior art pressure switches is generally fixed at approximately 2-½ inches of water around the lower impeller area of the pump housing to make sure the pump impeller remains submerged in water to avoid cavitation during its operation. And again most pressure switches in a pump housing set at a constant trip point of approximately 9 inches of water with respect to the depth of water in the sump well.

So different sump wells often require different water levels to trigger the action of the sump pump to properly drain the sump well. The prior art pressure switches generally fail to have any field adjustments to their factory set trip point and are not capable because of their designs to even have an adjustable trip point. So there is simply no differential setting for the trip point of the switch.

Many of the submersible sump pump housing include a built-in pressure responsive electrical switch that are adapted to actuate the electric motor of the sump pump when the liquid level reaches a predetermined height within the sump well. On the other hand, the vertical stand-up sump pump, in which the motor is positioned well above the liquid level, usually employs a float-actuated type of switch mechanism, with the switch normally being disposed at the very top of the structure, for example, mounted on the motor and responsive to the movement of the float.

Other electrical pressure switch designs for a commercial or residential submersible sump pump are designed for use with a Stevens Pump Company submersible sump pump having a completely assembled ready to install, quiet, dependable ⅓ HP, oil-filled, shaded pole motor designed for reliability and long life. Such a sump pump by Stevens Pump Company is a highly engineered product meeting all known quality standards for sump pumps. The sump pump includes an overload protector with positive protection against motor burnout. The pump generally provides an approximate cycle rate of 180 gallons/hr. For environmental safety, no mercury is used within the structure of the sump pump. The sump pump housing further includes corrosion inhibitors used to protect electrical connections including the electrical pressure switch. Electrical pressure switches are a dependable switching system that has proven reliable in 25 years of testing in the field. The Stevens' submersible sump pump is considered a high capacity submersible sump pump system that pumps more water than generally any other pump of comparable class and type. The housing of the submersible sump pump is of a high tech, chemically coupled, glass-filled polypropylene cover employed for lightweight, cool operation and superior impact resistance. The pump motor is generally a cast iron construction and its electrical pressure switch includes a funnel stem that fits into a pump housing having an air tube in communication with the water in the sump well. When the water rises within the sump well, it causes air pressure to increase on the pump housing and enter through the hole or nipple on the tip of the stem connected to the pneumatic chamber of the electrical pressure switch to actuate a neoprene or other suitable diaphragm therein. The air pressure causes the movement upwardly of the diaphragm to close the electrical contacts within the switch and actuate the pump motor, which causes the pump to drain the sump well to a predetermined level whereby the switch resets to the off position. The diaphragm then returns to its normal position opening the electrical contacts and shutting off the pump motor. The desired state is to equip the Stevens Sump Pump System with a pressure differential switch that includes a trip point that can be adjusted in the field to cover a wider range of applications.

Turning now in greater detail to solving the above mentioned problems experienced with such prior art electrical pressure switches employed with submersible sump pumps, the prior art electrical pressure switch generally included a two piece inlet stem attached to a cup holding the diaphragm actuated by a change of air pressure in a tube when the water rises up in the tube. This two-piece construction of steel nipple or stem inlet being press fit together with the cup is ripe for moisture problems. The nipple or stem is often just press fit to the cap that leaks under pressure allowing moisture leakage into the switch interior, which may lead to corrosion of its electrical components therein. This moisture leakage can badly corrode the electrical contacts within the switch compartment causing premature failure of the pressure switch. It will be appreciated that where a submersible pump is involved, the pressure switch electrical contacts and lines must be sealed suitably with respect to the liquid being pumped, and if the switch fails to properly operate the pump must be removed and repaired. This in turn will normally entail disconnection of the pump discharge line, often in the form of a rigid or semi-rigid metal or plastic type, necessitating a substantial down period during which the sump pump is inoperable.

Next, electrical grade phenolic material generally makes up the rest of the housing and it is usually press fit and sealed to the cup structure. Prior art electrical pressure switches using phenolic material that often releases residual ammonia over time from the phenolic material when formed during the molding process. This ammonia release over time from the phenolic material used in building prior art pressure switches is highly corrosive to the electrical components especially the electrical contacts within the switch and can also cause premature failure of the electrical parts of the pressure switch.

In addition, many pressure switches used with submersible sump pumps do not have any adjustable differential to adjust the trip point of the switch prior to or after installation of the submersible sump pump. There is simply no means or scale on any portion of the switch to adjust to adjust spring pressure internally or externally that is viewable on the pressure switch to provide any indications required to make any necessary adjusts to the trip point of the prior art pressure switches.

So any exterior screws or other fasteners on the back of the prior art pressure switches are preset and generally locked in place by a sealant or its mechanical design at the factory for maintaining a fixed trip point and therefore, the switches are not designed to be adjustable in the field. Moreover, the metal cup and its stem in most prior art switches are of a two-piece construction and the stem includes a large opening to the pneumatic chamber. The large opening to the pneumatic chamber of the switch often allows the reset spring means to prematurely reset the electrical contact points of the switch thereby restricting any attempts, even if any exterior means existed on the switch for adjustment, from the inclusion of any meaningful differential trip point for the prior art pressure switch designs.

The present invention is provided to solve the problems discussed above and other problems, and to provide advantages and aspects not provided by prior pressure switches of this type. A full discussion of the features and advantages of the present invention is deferred to the following detailed description, which proceeds with reference to the accompanying drawings.

SUMMARY OF THE INVENTION

An electrical pressure switch for a submersible sump pump having an exterior adjustable mechanism for providing a generally infinitely variable differential trip point depending upon the vertical height of the water within the water column enclosure associated with the submersible sump pump. The differential pressure switch includes a casing having a one piece, pneumatic sensing lower half with a pressure responsive diaphragm, the movement of which under pressure causes a diaphragm holder to engage a spring plate having a bottom electrical contact and a control spring between movable portions of the spring plate and a fixed electrical contact located on an upper half of the casing to form a pair of normally open electrical contacts to close that are electrically connected to a pair of terminals for connecting the motor of the sump pump in circuit with a source of power. The upper half of the casing having the electrical fixed electrical contact closes with the bottom contact to complete the motor circuit. The lower half of the casing includes a seamless metal nipple or stem that is integral with a metal base cup or lower half casing for holding the diaphragm and diaphragm holder in place and to seal against the metal cup interior to provide a generally leak proof moisture seal between the diaphragm and the electrical components in the upper casing. The material used in the upper half of the casing is an ammonia free material of phenolic, glass fiber or other suitable material or the like connected to the stem cup in a sealed manner for enclosing and protecting the electrical components of the switch in a generally ammonia and moisture free environment.

An adjustable knob located on the vertical axis of the switch and partially disposed within the upper half of the casing along a center axial opening of the casing includes a spring biasing the knob upwardly in the central opening of the casing with a scale of graduations on the external surface of the knob. The knob is movably held in place within the portion of the upper casing central opening by a generally flat metal bracket attached at one end to the upper exterior of the casing. The bracket is shaped to extend over the top of the knob with a threaded hole therethrough axially aligned with the knob to capture a threaded fastener like a thumbscrew extending through the threaded bracket hole to have its distal end engage the top of the knob for making spring tension adjustments that result in a differential trip point for the pressure switch. Spring tension for the knob is created by a pair of concentric springs, a large spring mounted over a hollow spring holder with a smaller spring within the hollow cavity of the spring holder and a pillar axially aligned with the thumbscrew, knob, large spring, spring holder and smaller spring to compress the small spring within the hollow of the spring holder as an axial post extending upwardly on the top of the diaphragm holder to engage an axial hole in the base of the pillar of a predetermined depth and the axial post pushes upwardly on the pillar causing the pillar to further compress the smaller spring first and then finally compress the large spring as the air pressure increases causing a control spring on a spring plate with a movable bottom electrical contact to snap over at the preset differential trip point and thereby moving the bottom contact on the spring plate against a fixed top electrical contact mounted on the ammonia free phenolic upper half of the casing to complete the circuit and thereby power the sump pump motor. As the thumbscrew is turned downwardly on the top of the knob, the air pressure required to snap over the control spring to close the normally open contacts increases corresponding to an increase in the depth of the water in the sump well before the sump pump is actuated.

The knob only has a portion of its length exposed or extending above the upper half of the casing with scale graduations thereon its vertical exterior to allow the end user to field adjust the trip point of the sump pump to a predetermined depth of the water in sump well. The combination of the thumbscrew and side scale generally creates repeatable settings for the trip point of the switch permitting the end user to set the water depth in the sump well to whatever water level is desired by the end user. The metal bracket with the thumbscrew fastener affixedly attached thereto and axially bearing down at its distal end on the top of the knob includes an upper end with digit surface making it easy to turn and screw down or up on the knob to increase or decrease, respectively, the overall spring pressure of both the large and smaller springs by adjusting the larger spring pressure on the spring holder without the use of any special tools. The digit surface can be turned by just the thumb and forefinger. When turning the thumbscrew adjustment, the distal end thereof pushes axially downwardly on the knob causing the large spring to compress against the spring holder and thereby compressing the smaller spring within the spring holder cavity resulting in the increasing the amount of air pressure required for the trip point of control spring to close the electrical contacts and power the motor of the sump pump. The thumbscrew also provides essentially an infinite number of variable or differential trip points by the end user. The thumbscrew fastener generally remains at its finger settings during the pump cycling with its vibrations because of an inclusion of a retaining nut with a nylon insert or the like mounted on the underside of the screw hold on the bracket preventing the thumbscrew from backing out or moving during any vibrations caused by the pump motor or pumping action. Yet, the thumbscrew easily adjusts by a simple touch of the thumb and forefinger. This provides the pressure switch of the present invention with an adjustable pump differential by having a pressure switch with variable trip points. The thumbscrew fastener on the top of the upper half of the casing of the pressure switch is designed only to alter the trip point; the reset point generally will remain constant throughout the sump pump operation.

In addition, the drawn stem or nipple of the cup includes a smaller opening in communication with a pneumatic chamber of the switch, which helps to prevent the inadvertent reset of the electrical contact points by the reset spring during water level drops thereby creating a repeatable differential between the reset and trip points on the pressure switch. Thus, the reset point is generally set to a constant 2- ½ inch of water column height to keep the impeller of the pump motor submerged and the differential trip point is generally able to range from 9 to 22 inches of water column height. This is a vast improvement over all known prior art pressure switches for submersible sump pump applications.

Other features and advantages of the invention will be apparent from the following specification taken in conjunction with the following drawings.

DETAILED DESCRIPTION OF THE INVENTION

Figure 1:
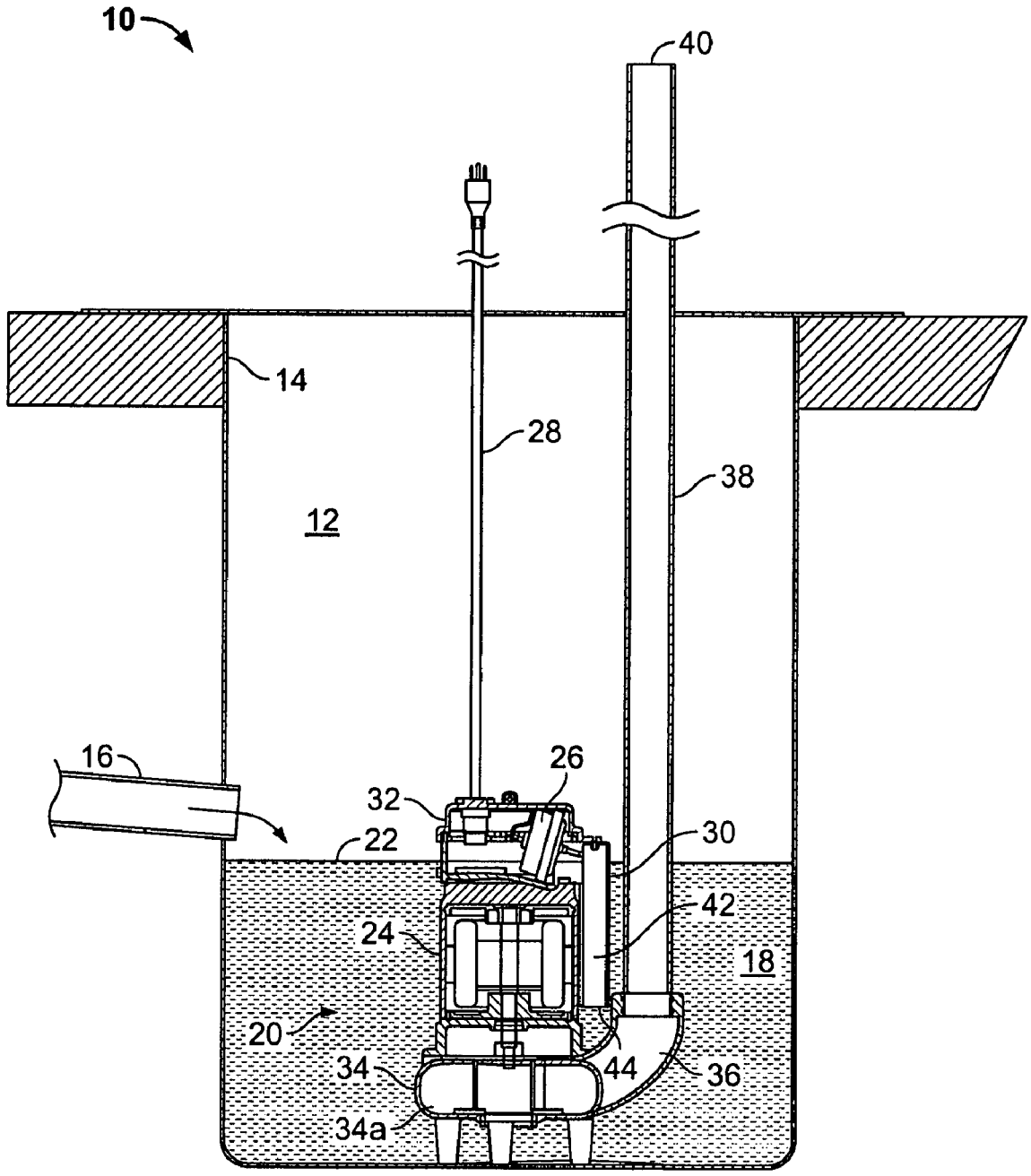
FIG. 1 show a side view, partly diagrammatic, of a typical installation of a submersible sump pump in a sump well and a partial diagrammatic cross sectional view of the sump pump and housing with a pressure switch made in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings for details of my invention and its preferred form, a submersible sump pump system 10 is illustrated in FIG. 1. A sump well 12 generally includes a liner 14, a discharge water pipe 16 into the sump well 12 and water 18 at a predetermined level. The water 18 generally covers a predetermined amount of a submersible sump pump assembly 20. The water level 22 in the sump well 12 is shown generally covering a predetermined amount of a pump housing 24 so that the pump assembly 20 and its impeller which may be lubricated and cooled by the water passing therethrough without cavitation.

A pressure responsive electrical switch assembly 26 appropriately interconnected electrically with the sump pump assembly 20 by an electrical cable or cord 28, and the air pressure is connected by tubing or vertical water column enclosure 30 to the input of the switch 26. The sump pump assembly 20 involves a housing including an upper half casing or top pump assembly section 32 providing a motor chamber and a lower half casing or base pump section 34, which houses the pump impeller that is normally mounted on the motor shaft. Water discharge from the pump is guided to a fitting 36, which terminates in a connection with a rigid cast iron, PVC pipe or a hose 38. The rigid pipe or hose 38 extends the height of the sump well 12 and is connected to the exterior of the sump well 12 for conducting a water discharge end 40 to some remote point from the sump well. The electrical cord 28 for connecting the pump motor to a source of power is taken out through the top opening of the sump well 12 that is generally sealed against intake of moisture or debris by a cover 12*a* or even left open in some circumstances.

Mounted on one side of the pump housing 24 is the vertical air tube 30 creating an air pocket 42 open at its lower distal end to permit entrance of water therein. Upon a rise in the water level within the sump well 12, the air pocket 42 within air column enclosure 30 is compressed to provide a source of air pressure to the pressure responsive switch assembly 26. It is apparent that as the water rises in the sump well and also the corresponding enclosure 30, the air trapped within the air pocket 42 will be compressed and develop further pressure in the tubing or enclosure 30 to which the pressure responsive switch 26 will respond. The air pocket 42 is of substantial volume compared to the overall volume within diameter of the tubing or enclosure 30, whereby the necessary pneumatic pressure will be developed in response to but a slight rise in elevation of the water 18 within the enclosure 30 compressing the air pocket 42, thereby rendering the system sensitive to water level 18 after the water enters the column or enclosure 30. Preferably, the air pocket 42 and its enclosure 30 is installed above the lower half of the casing or pump section 34 to assure that the pump during periods of operation, will have its impeller and bearings entirely submerged in water 18, whereby the bearings, may be water cooled at all times during operation of the pump motor with its assembly 20.

Figure 2:
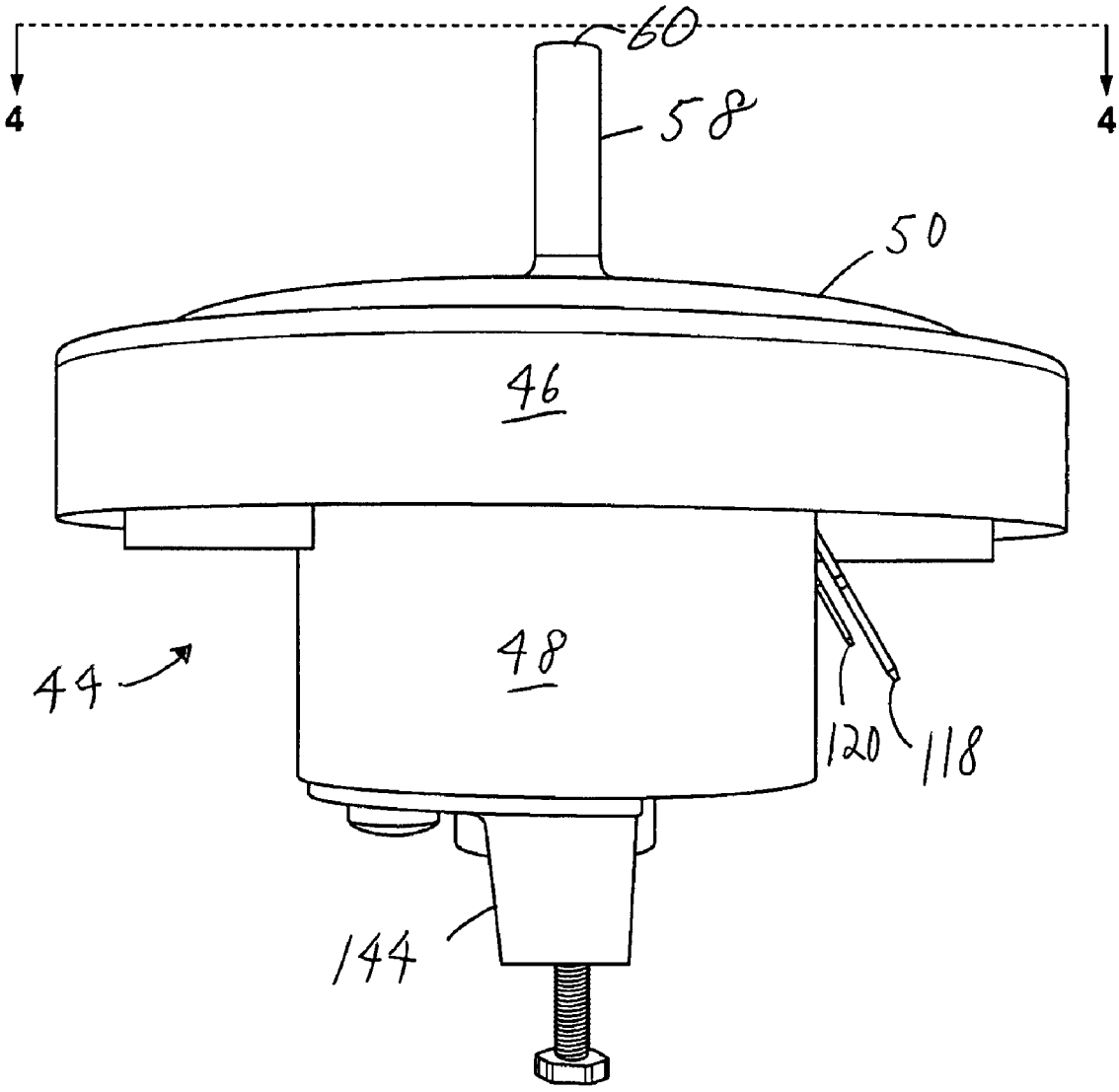
FIG. 2 shows is a vertical elevation of the pressure switch of FIG. 1
Figure 3:
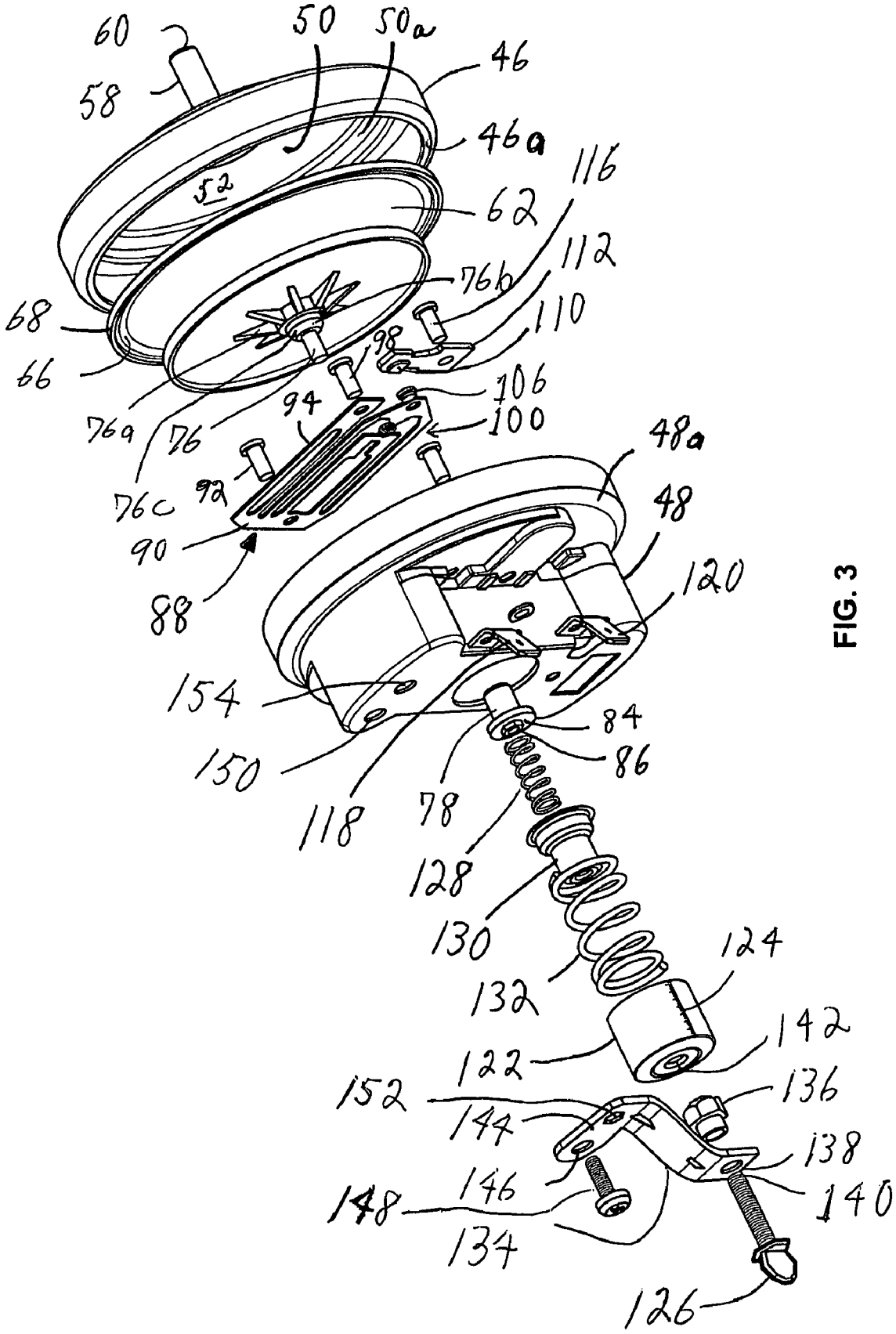
FIG. 3 is a an exploded perspective view of the pressure switch of FIG. 1.

As shown in FIG. 1, the pressure switch 26 consists of a two-part housing or casing 44, as shown in FIG. 2, containing assorted pneumatic and electrical components therein to be described in greater detail later. A one-piece stamped metal housing 46 of a predetermined diameter forms the lower half of the casing 44 and a generally ammonia free phenolic circular cap 48 of a predetermined diameter forms the upper half of the casing 46. The diameter of the cap 48 is slightly smaller than the diameter of the housing 46 such that the cap 48 is inserted into the top half of the cup wherein a metal edge 46*a*, as shown in FIG. 3, of the cup is crimped over a circumference portion 48a of the lower base of the cap 48 to capture it therein for the final assembly of the pressure switch 26, as shown in FIG. 1. The metal cup 46 includes a circular recess 50 with tapered sides 50a extending inwardly to a generally flat bottom 52 of the recess 50 in the lower portion of the cup 46 with a diameter less than an outer edge 54 of the cup 46. In a center or axis 56 of the cup 46 is a drawn stem 58 integral with the bottom 52 of the recess 50 and extending downwardly a predetermined distance before terminating in an opening 60.

Figure 4:
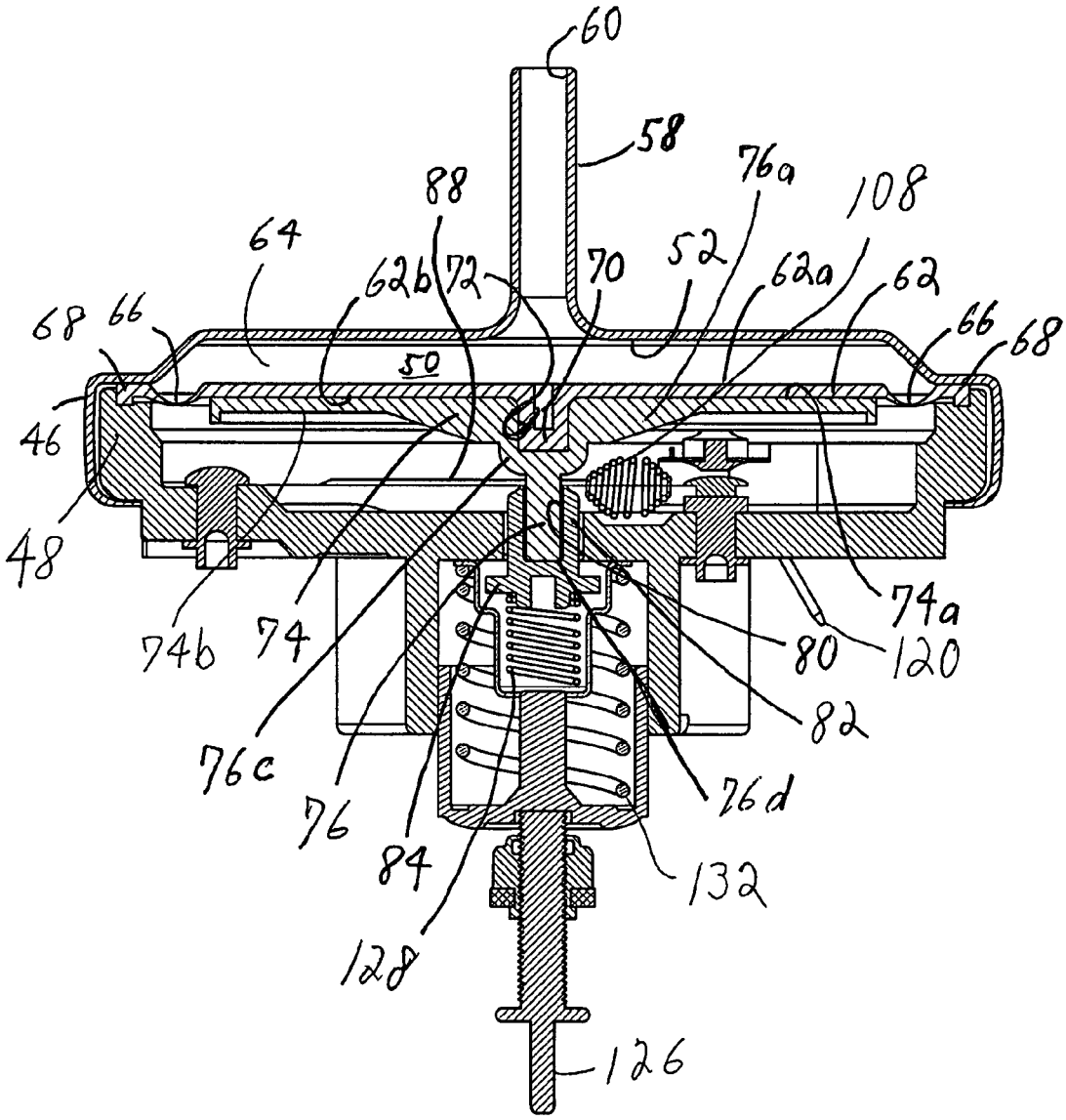
FIG. 4 is a partial elevation cross section taken along lines 4-4 of FIG. 2 having a first setting.
Figure 5:
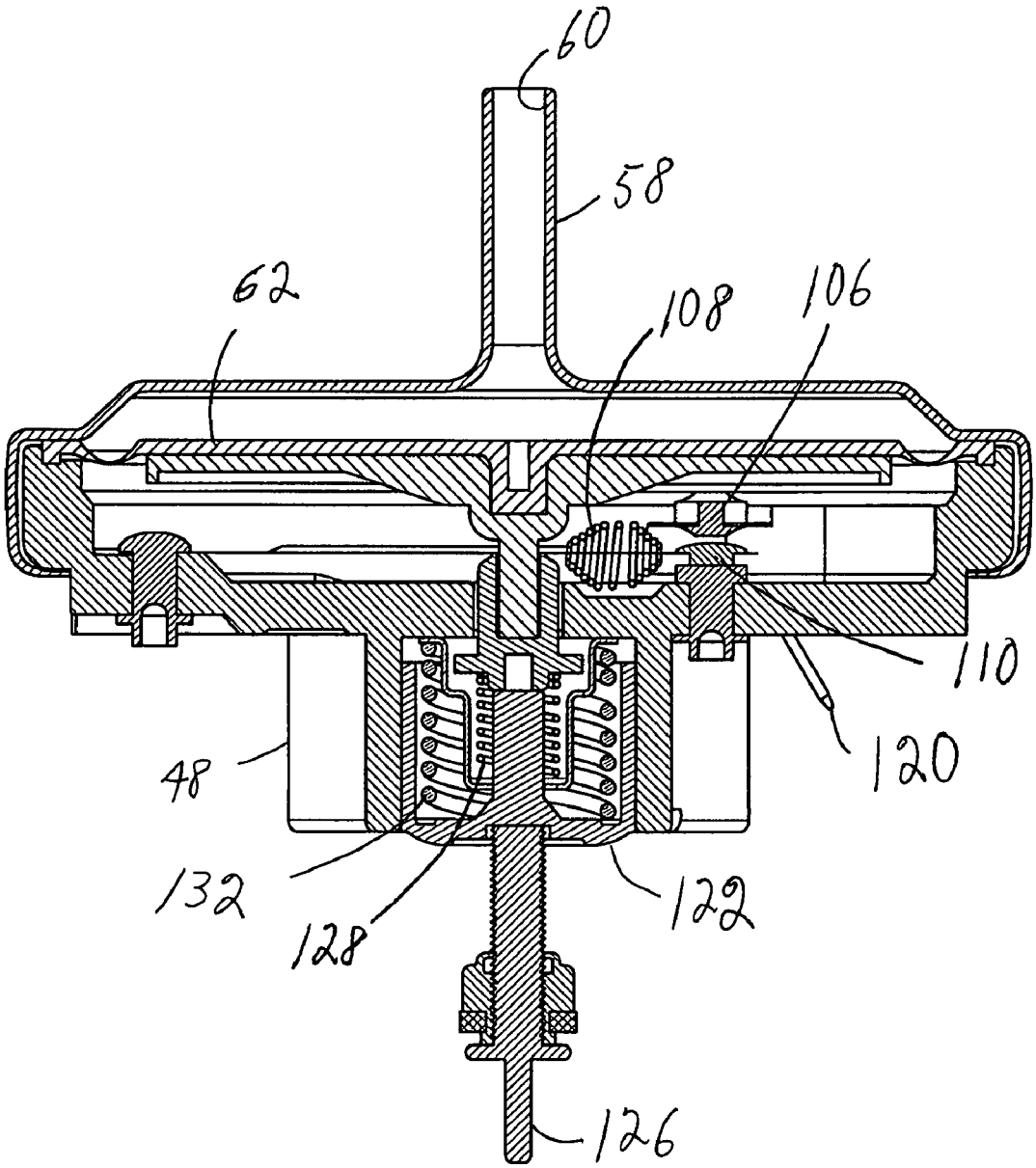
FIG. 5 is a partial elevation cross sectional view taken along lines 4-4 of FIG. 2 having a second setting.

A generally flat, flexible and circular diaphragm 62 having a diameter large enough to seal the top of the recess 50, as shown in FIGS. 4 and 5, forms a pneumatic air chamber 64. One side of the diaphragm 62*a* faces the recess 50 to form the air chamber 64 having a slightly tapered and flexible rim portion 66 near an outer edge 68 of the diaphragm 62 that mates with the tapered surface of the recess 50. The other side of the diaphragm 62*b* includes an axial nipple 70 that extends upwardly a predetermined distance. The nipple 70 is press fit into an axial opening 72 on one side of a generally flat, rigid and circular diaphragm holder 74 having a diameter smaller than the flexible diaphragm 62 and ending prior to reaching the tapered and flexible rim 66 on the diaphragm 62. One side 74*a* of the diaphragm holder 74 mates with a top surface 62B of the diaphragm 62 to transmit the upward movement of the diaphragm 62 when the air pressure received within air chamber 64 causes the diaphragm 62 to flex axially upward along its flexible rim 66 while its edge 68 is clamped tightly between the cup 46 and cap 48. The other side 74*b* of the diaphragm holder 74 is also generally flat and rigid that includes an axial post 76 of varying dimension extending upwardly from the flat side 74*b* of the diaphragm holder 74. The axial post 76 further includes a star shaped base 76*a* extending radius outwardly from a circular base section 76*b*, as shown in FIG. 3, of the post 76 terminating approximately half way up the post 76 in a bulbous shoulder 76*c* with an upper end 76*d* of the post 76 having a diameter that is less than the base 76*b* and bulbous shoulder 76*c* extending axially above the nose a predetermined distance.

As shown in FIG. 3, a pillar 78 includes an axial recess 80, as shown in FIG. 4, on its lower end 82 and a flange 84 around the pillar circumference near its other end 86, as shown in FIG. 3. The upper end 76*d*, as shown in FIG. 4, of the axial post 76 fits into the recess 80 to transmit the upward motion into the pillar 78, as shown in FIG. 3. A flexible copper alloy spring plate 88 of an irregular configuration extending across the interior of the cap 48 and generally perpendicular to the axis of the pillar 78 is interposed between the bulbous shoulder 76*c* and the lower end 82, as shown in FIG. 4, of the pillar 78, as shown in FIG. 3. The flexible spring plate 88, as shown in FIG. 4, includes a generally rectangular base 90, as shown in FIG. 7, attached by a rivet 92 to the interior of the phenolic cap 48 having a first stationary and generally rectangular member 94 extending from the base 90 across the interior of the cap 48 in generally the same plane as the base 90 a predetermined distance before terminating in an end 96 affixed to the cap 48 by a rivet 98.

A second generally rectangular and flexible member 100 on the spring plate includes two flexing members 102 and 104 therein with flexible member 104 located generally inside the other in slightly different planes over their entire predetermined length and width. The first flexible member 102 includes a pair of legs 102*a* and 102*b* spaced apart a predetermined distance and attached at one end 103 to the base 90 and extending across the interior of the cap 48 and joined together in an arched opposing end 102*c* having a movable electrical contact 106 centered in the arch of opposing end 102*c* and having a tab 102*d* centered and projecting inwardly from the arched end 102*c*. In the space between the pair of legs 102*a* and 102*b*, the second flexible member 104 is located and is in a slightly different plane over its entire width and length from flexible member 102. Member 104 includes a pair of legs 104*a* and 104*b* in a spaced apart relationship with respect to each other that are attached at one end 105 to the base 90 and extends across the interior of the cap 48 before terminating in a generally square end 104c having a tab 104*d* extending beyond the end 104*c* and centered between the pair of legs 104*a* and 104*b* and having an inwardly facing arch 104*e* in which the arch is large enough to pass the upper end 76*d*, as shown in FIG. 4, of the post pass through the arch opening but small enough to block the bulbous shoulder 76*c* from passing through the arch 104*e*, as shown in FIG. 7. Instead, the bulbous nose 76*c*, as shown in FIG. 4, engages the arch sides and causes the movement of members 102 and 104, as shown in FIG. 7, with respect to one another.

Figure 7:
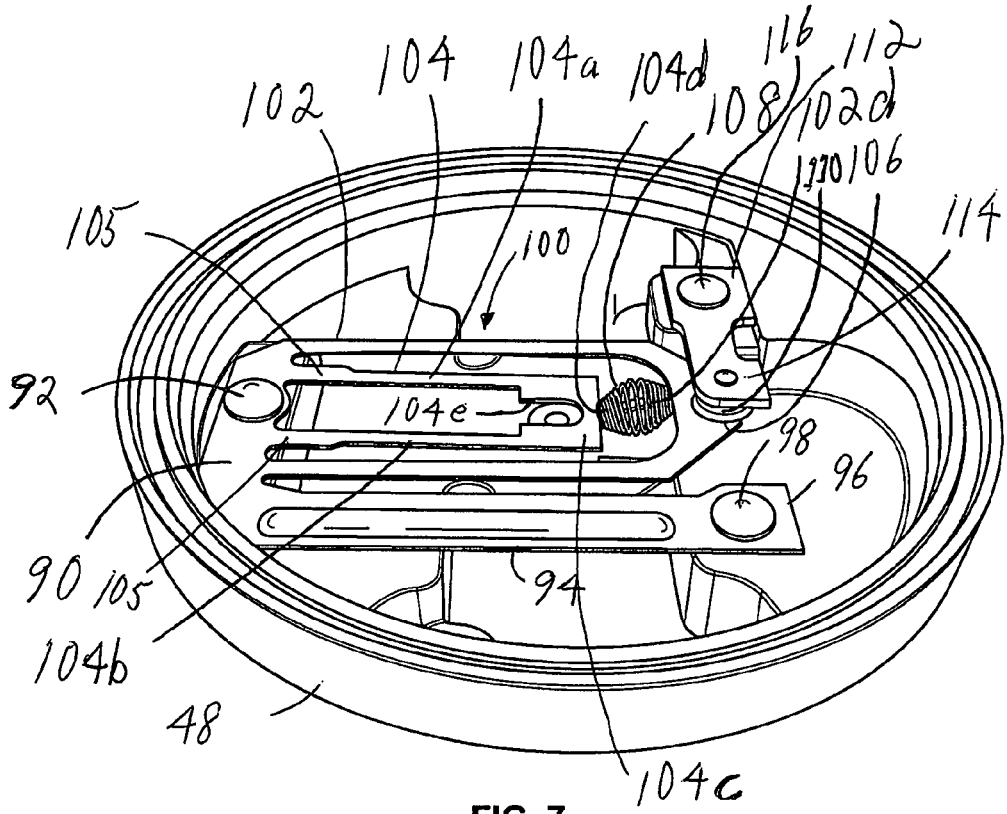
FIG. 7 is a partial view of an upper half of the switch casing showing closed electrical contacts of the pressure of FIG. 1.

A generally conical control spring 108, as shown in FIG. 7, is affixed at either end to the tabs 102*d* and 104*d* to spring bias the flexing members 102 and 104 with respect to each other into slightly different planes from one another. In the normal open contact state when the diaphragm has no pressure against its flexible membrane, the control spring 108 biases member 104 slightly upward from the plane of member 102 with movable electrical contact 106 such that the movable electrical contact is separated from a fixed electrical contact 110 to form the normally open contacts of the pressure switch when there is no rising water and resulting air pressure to activate the switch 26, as shown in FIG. 1. When air pressure is sensed and it equals the trip point set of the differential switch, the member 104 is moved upwardly by the bulbous shoulder 76*c*, as shown in FIG. 4, engaging the arch 104*e*, as shown in FIG. 7, of the member 104 causing the control spring 108 to snap over. The snap over action of the control spring 108 forces the member 102 to flex downwardly forcing the movable electrical contact 106 to close against the fixed electrical contact 110 and thereby closing the circuit and applying power to the sump pump motor.

Figure 6:
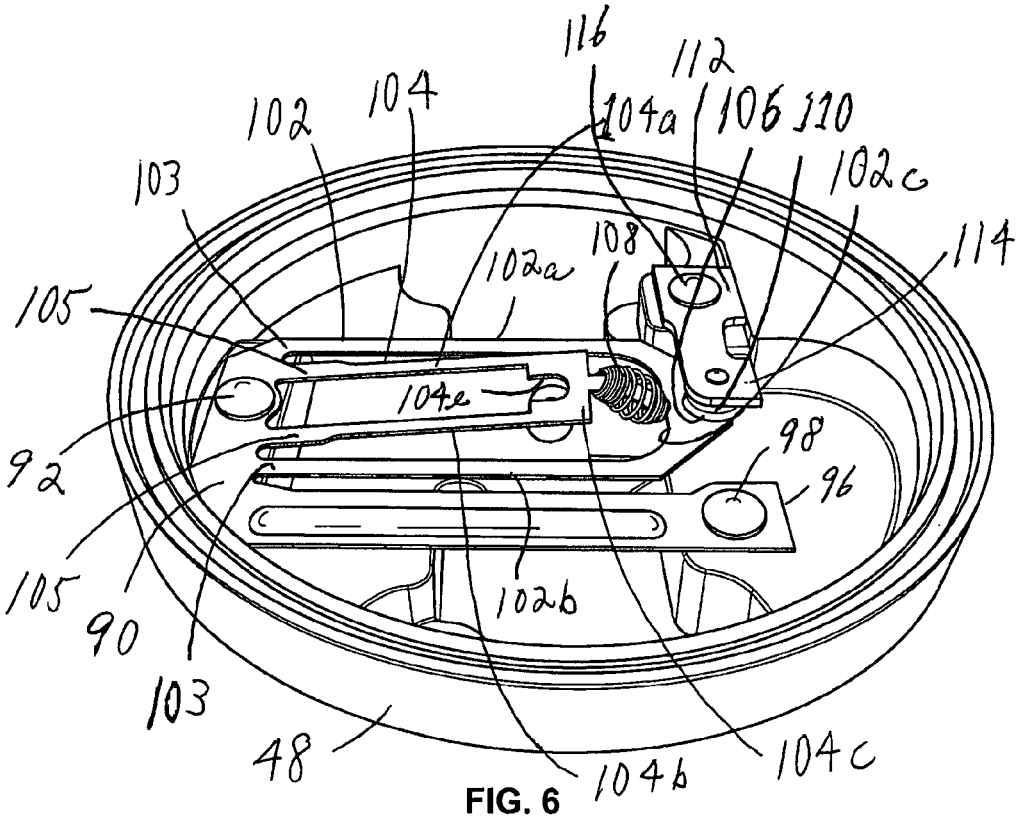
FIG. 6 is a partial view of an upper half of the switch casing showing normally open electrical contacts of the pressure switch of FIG. 1.

Next, the fixed electrical contact 110 is attached to an electrical contact arm 112 centering the fixed electrical contact 110 axially over the movable electrical contact 106 at a distal end 114 of the arm 112 and a rivet 116 attaches the other end of the arm 112 to the interior of the cap 48. So when the air pressure increases due to rising water in the sump well 12, as shown in FIG. 1, and the spring plate 88, as shown in FIG. 3, has it members 102, as shown in FIG. 6, and 104 flexed causing the electrical contacts to close, the sump pump motor is energized and the sump well water level is lowered by the discharge of water through the pipe 38, as shown in FIG. 1. The stem 58, as shown in FIG. 3, is inserted into the water column enclosure 30, as shown in FIG. 1, in a generally sealed manner at the top of the enclosure where the trapped air 42 creates the air pressure corresponding to the rise of water within the sump well and in the column enclosure. The stem 58, as shown in FIG. 3, is mounted to the center of the recess 50 and its opening 60 feeds air pressure to the pneumatic chamber 64, as shown in FIG. 4, for moving the diaphragm 62 in an axial direction with respect to the stem 58. The diaphragm 62 seals against the circumference of the recess 50 so the air pressure is captured within the recess 50 and air chamber 64 formed between the two. The casing 44 on the pressure side of the diaphragm 62 is provided with the stem or nipple 58 that is connected to the tubing 30, as shown in FIG. 1, having the air pocket 42, whereby compression of air trapped within the air pocket 42 will develop and transmit the air pressure to the diaphragm 62, as shown in FIG. 4. The movement of diaphragm 62 upwardly flexes the spring plate 88, as shown in FIG. 1, to close the switch contacts 106 and 110, when the pressure reaches a predetermined value.

When the electrical contacts 106 and 110, as shown in FIG. 5, are closed together, a pair of terminals 118 and 120 are attached by rivets 98 and 116 are electrically connected to one another as shown in FIGS. 3, 6 and 7 permitting current to flow to the pump motor.

From the foregoing, it will be apparent that the differential pressure switch 26, as shown in FIG. 1, of the present invention can either be located within the pump housing 24 or located in a remote location with respect to the pump 20 if so desired for easy access to the pressure switch for adjustments, not shown. In this configuration, the enclosure 30 would be separated from the pump housing and be a stand alone component within the sump well with the stem 58, as shown in FIG. 5, attached to the air pocket 42, as shown in FIG. 1, near the top of the enclosure. Since the pressure switch assembly 26 is a separate component within the sump pump system itself in FIG. 1, any repairs or replacements may be accomplished with the least amount of difficulty, and with no disturbance to the submersible sump pump assembly itself if the switch were located outside of the pump housing assembly 20.

Now reviewing the installations of the submersible sump pump and the differential pressure switch in FIGS. 1, the typical submersible sump pump installation 10 in a sump well 12 receives drain tile water 18 around the foundation of a residence or commercial building through the drain pipe 16. The depth of the water 18 in the sump well 12 from installation to installation may differ greatly. Unless, the pressure switch 26 includes an adjustable differential on the pressure responsive switch 26, the pressure switch located within the pump housing 24 or mounted adjacent the sump pump on top of the enclosure 30 will be unable to maintain the appropriate water level for all different types of installations.

The sump pump assembly system 10 includes a cast iron motor housing 24 as shown in FIG. 1. The cast iron motor housing 24 including the upper portion 32 providing a mounting for the electrical switch and a mounting for the motor chamber while the base section 34 provides the pumping action, which houses the pump-impeller chamber 34*a* where the impeller is normally mounted to the motor shaft to be driven thereby.

The pumping action propels the water discharge 40 from the discharge pipe 38 to which further piping is generally connected (not shown) for conducting the discharged water 40 to some remote discharge point away from the sump well 12. The electrical cord 28 for connecting the pump motor 20 to a source of power is taken out through an opening in the cover 12*a* or open sump well 12. Depending upon the configuration of the sump well 12, the pressure switch will generally required more than the normal fixed factory setting to handle the sump well configurations.

In operation, the pressure switch 26 senses the air pressure within the tube or enclosure 30 to close or open the electrical contacts 106 and 110, as shown in FIG. 3, of the switch. The air pressure value is adjustable. A knob 122 is printed with a scale 124 from 0 to 6 markings. Each step has different pressure values. The pressure is adjusted by turning the adjustable bolt or thumbscrew 126 in or out. When the thumbscrew 126 is turned all the way out, the least amount of air pressure will actuate the switch and vice versa. In other words, at "0" position on the scale of the knob 122 without any graduations 124 showing; it is the highest pressure to turn on the switch. At "6" position on the scale 124; it is the lowest pressure to turn on the switch.

The switching on sequence occurs as follows for the differential pressure switch 26, as shown in FIG. 1. The switch 26 is initially off (no air pressure in through tube 30). When air pressure increases in through the stem 58, as shown in FIG. 3, into the pneumatic chamber 64, as shown in FIG. 4, of the switch 26, the diaphragm 62 is pushed or flexed upwardly, which in turn pushes the diaphragm holder 74, the pillar 78 and finally compressing a small spring 128. When the air pressure within the pneumatic chamber 64 is further increased, the pillar 78, as shown in FIG. 3, moves up and pushes a small spring holder 130 in a further upward movement. When the air pressure is large enough in the tube 30, as shown in FIG. 1, and pneumatic chamber 64, as shown in FIG. 4, a large spring 132 is compressed and the electrical contact control spring 108 located between flexible parts or tabs 102*d* and 104*d*, as shown in FIG. 7, on the conductive spring plate 88, as shown in FIG. 3, having the bottom electrical contact 106 is pulled upwardly in a snap over action to engage the top stationary electrical contact 110, which result in closing the contacts 106 and 110 to complete the circuit to start the pump motor. The electrical terminal 118 and the electrical terminal 120 are now completing the electrical circuit connection with one another to energize the sump pump motor.

Next, the switch off sequence begins to occur when the air pressure is decreased in the pneumatic chamber 64, as shown in FIG. 4, the diaphragm 62 moves down and the large spring 132 is restored first to its original position. When the air pressure is further decreased, the small spring 128 is restored to its original resting position. Next, as the air pressure becomes small enough, the control spring 108 is activated to snap over in the opposite direction from closing and the electrical contacts 106 and 110, as shown in FIG. 3, are now opened. That is the terminal 118 and terminal 120 are no longer completing the electrical circuit connection with one another and the pump motor is de-energized and stops.

Below are the tables summarized the ON/OFF procedures step by step.

| Switch ON | | | | | | |
|---|---|---|---|---|---|---|
| Air Pressure | Diaphragm | Small Spring | Large Spring | Control Spring | Contacts | Terminals A and B |
| No | Stationary | No compression | No compression | No activation | Open | No connection |
| Air pressure flows in | Moving upwardly | Compression | No compression | No activation | Open | No connection |
| Air pressure is further increased | Moving upward | Compressed to max. | Compression | No activation | Open | No connection |

-continued

| Switch ON | | | | | | |
|---|---|---|---|---|---|---|
| Air Pressure | Diaphragm | Small Spring | Large Spring | Control Spring | Contacts | Terminals A and B |
| When the pressure is large enough | Moving upward | Compressed to max. | Compression | Activated | Close | Connected |

| Switch OFF | | | | | | |
|---|---|---|---|---|---|---|
| Air Pressure | Diaphragm | Small Spring | Large Spring | Control Spring | Contacts | Terminals A and B |
| When the pressure is decreased | Moving downward | Compressed to max. | Start to restore | No activation | Close | Connected |
| Air pressure is further decreased | Moving downward | Start to restore | Restored | No activation | Close | Connected |
| When the pressure is small enough | Moving downward | Restored | Restored | Activated | Open | No connection |

So the unique combination of the pneumatic chamber 64, as shown in FIG. 4, acting upon the diaphragm 62 and diaphragm holder 74 with increasing air pressure 42, as shown in FIG. 1, therein to push against the pillar 78, as shown in FIG. 3, to first compress the small spring 128 which in turn pushes against the spring holder 130 to start the compression of the large spring 132. When the large spring 132 compresses far enough then the control spring 108, as shown in FIG. 4, on the spring plate 88, as shown in FIG. 3, is activated causing the lower electrical contact 106 on the spring plate 88 to snap over against the upper stationary contact 110 to complete the circuit between the terminals 118 and 120 to energize the sump pump motor. The combination of the smaller spring 128 within the spring holder 130 and the larger spring 132 against the spring holder 130 and knob 122, respectively, provides the surprising results of a pressure switch 26, as shown in FIG. 1, that when the thumb screw 126, as shown in FIG. 3, is adjusted downwardly or upwardly against the top of the knob 122, the trip point for closing the electrical contacts 106 and 110, as shown in FIG. 5, and actuating the pump motor varies with the adjustment of knob 122 by the thumbscrew 126. The exteriorly mounted thumbscrew 126 provides the user with an easily accessible point to change the adjustment on the trip point setting in the filed to match the desired water level within the sump well 12, as shown in FIG. 1, which prior art pressure switches lacked the ability to so be adjusted at all in the field. An important part of the adjustable knob 122, as shown in FIG. 3, is the engagement of the thumbscrew 126. The thumbscrew 126 is held in place above the center of the knob 122 by a angled support bracket 134 having a nylon lined nut 136 inserted in an opening 138 at one end that is generally positioned perpendicular to the axis of the knob 122 in which the threads on the thumbscrew 126 are passed therethrough so a distal end 140 of the thumbscrew 126 engages a top center recess 142 of the knob 122. The nylon lined portion of the nut 136 makes sure the setting of the thumbscrew against the knob 122 does not change during operation of the sump pump and any vibrations that the pressure switches incurs while mounted within the sump pump housing during operation of the sump pump motor. The bracket 134 at its other end is angled downwardly from the opening 138 at the one end. The other end terminates in a flat portion 144 with a hole 146 to receive a screw 148 to fasten the bracket 134 against the top of the cap 48 having a screw hole 150 on its top surface. The flat portion 144 also includes a nib 152 extending downwardly from the rear of flat portion 144 to engage an indentation 154 spaced apart from the screw hole 148 a predetermined distance. This two-point contact with the screw 148 and nib 150 on top of the cap 48 makes sure the bracket 134 does not rotate on top of the cap 48 when fastened in place.

In the present invention, the pressure switch 26, as shown in FIG. 1, includes a fixed reset point. The pressure-reset point of the switch is fixed regardless of the setting of the pressure trip point. So for the prior art pressure switch, there is a fixed differential where, the pressure trip point and the reset pressure have a fixed difference between the two values such as 2-½" for the reset and 9- ½" for the trip point of the switch. For the present invention, there is a variable differential between the variable pressure trip point and the fixed pressure reset point so this difference between the points is proportional to the pressure trip setting by manually adjusting the thumbscrew 126, as shown in FIG. 3. The unique combination of the smaller spring 128 within the spring holder 130 and concentrically mounted with respect to the larger spring 132 on top of the spring holder 130 creates this variable setting along with the pillar 78. The thumbscrew 126 engaging the knob top recess 142 to compress the larger and smaller concentrically arranged springs provides the pressure switch differential adjustment to create the various settings for different water levels within the sump well before the sump pump is actuated.

While I have illustrated and described my invention in its preferred form, it will be apparent that the same is subject to alteration and modification without departing from the underlying principles involved. As one example, the air pocket may be mounted for vertical adjustment to alter the level at which the pressure switch will function. I accordingly do not desire to be limited in my protection to the specific details illustrated and described, except as may be necessitated by the appended claims.

While the specific embodiments have been illustrated and described, numerous modifications come to mind without significantly departing from the spirit of the invention, and the scope of protection is only limited by the scope of the accompanying Claims.

What is claimed is:

1. In a pneumatic pressure operated electrical switch construction for a sump pump assembly comprising a housing, a pressure responsive actuator carried by the housing, an electrical switch having a pair of electrical contacts, one movable and one stationary carried by the housing and being operatively associated with the actuator so that the actuator will operate the switch from an on to off position depending upon the sensed pneumatic pressure reaching a predetermined pressure, and reset means carried by the housing for a constant resetting of the switch from its on position to its off position, the improvement comprising a first spring attached to portions of a spring plate having the one movable electrical contact to create a snap over action of the spring plate against the other stationary electrical contact affixed to the housing, a pillar connected to the actuator and engaging the spring plate, a second concentric spring engaging the pillar and having a spring holder thereover, a third spring concentric with the second spring and wound around the spring holder, a knob mounted over the third spring and partially disposed within the housing, a thumbscrew affixed to the housing and having a distal end axially aligned and adjustable in height above the knob for moving the knob either up or down along its vertical axis to adjust the compression of the second and third springs to set the trip point of the switch, wherein the pneumatic pressure against the actuator reaches a predetermined trip point causing the spring plate to move and snap over the movable electrical contact against the stationary contact on the housing to close the switch contacts to the on position, the pressure switch trip point differential being adjustable by the vertical movement of the thumbscrew distal end against the top of the knob and the first spring biasing the snap over motion to provide a constant reset point for the switch as the pressure against the actuator decreases to the predetermined level no matter what the trip point setting happens to be by adjusting the thumbscrew, the thumbscrew is rotatably mounted to the housing and axially aligned with the axis of the knob for adjusting the position of the knob within the housing to set the compression of the second and third springs, which sets the differential trip point and controls the snap over action of the first control spring in the closure of the electrical contacts to energize the sump pump assembly, wherein the thumbscrew is axially movable relative to the housing to set the trip point of the pressure switch, wherein the actuator is axially movable relative to the housing in opposing directions for the constant reset and the differential trip points for the pressure switch, and wherein the knob includes scale readings on its external surface for setting the trip point of the pressure switch by manual screwing the thumbscrew to raise or lower the height of the knob extending above the housing to correspond to a predetermined set point.

2. A pressure switch construction as set forth in claim 1, wherein the distal end of the thumbscrew moves when rotated in axial direction when engaging the knob to set the compression of the first and second springs thereunder to adjust the differential of the pressure switch.

3. A pressure switch construction comprising a housing, a pressure responsive actuator carried by the housing, an electrical switch carried by the housing and being operatively associated with the actuator so that the actuator will operate the switch from one condition thereof to another condition thereof when the sensed pressure reaches a predetermined pressure, a constant reset means carried by the housing for resetting the switch from the other condition thereof back to the one condition thereof, a pair of concentrically arranged springs, the first spring operatively connected to the actuator, a generally circular spring holder mounted over the first spring and a portion of the actuator, the second spring wound around the spring holder and extending thereabove a predetermined distance, a knob carried by the housing and covering a portion of the second spring, the spring holder and the first spring for acting on the actuator to provide a differential, predetermined trip point, and a manually adjustable means carried on the exterior of the housing for adjusting the position of the knob over the first and second springs to compress the springs to a desired condition and thereby adjusting the pressure trip point of the switch by the actuator, wherein the adjusting means axially adjusts the compression on the first and second springs when the adjusting means is manually moved relative to the housing in either direction against the axis of the knob and wherein the constant reset means remains unchanged with the movement of the knob with respect to the housing, wherein the adjusting means being rotatably mounted to the housing and thereby being rotated when moved in either an up or down axial direction thereof, said adjusting means being axially movable relative to said housing means to operate said reset means, said actuator being axially movable relative to said housing means in the same direction as the resetting movement of said adjusting means, the adjusting means having a mechanical bushing for locking the adjusting means in its selected rotational position thereof after adjustment.

4. A switch construction as set forth in claim 3, wherein the adjusting means is axially aligned with the top of the knob to move the knob downwardly to compress the first and second springs for setting the pressure level for the trip point of the switch.

5. A pressure switch construction as set forth in claim 3, wherein the adjustable means comprising a generally flat angled bracket affixed at one end to the housing and angled upwardly over the center of the knob in a generally perpendicular plane to the axis of the knob, the bracket having a hole inline with the axis of the knob, a thumbscrew fastener mounted in a rotational position with respect to the hole having a distal end acting against the top of the knob to compress the first and second springs to set the pressure trip point for the electrical switch, which provides approximately an infinite number of set trip points when the thumbscrew that is rotatably mounted to the housing by the bracket is rotated in either direction against the knob causing the knob to be axially movable relative to the housing for setting the trip point operation of the switch.

6. A pressure switch construction as set forth in claim 5, wherein the electrical switch having a pivotally mounted spring plate with an electrical contact operatively associated with the actuator and having a control spring mounted between portions of the spring plate for a snap over action when pivoted to place the movable contact against a fixed electrical contact to complete the circuit between the contacts for powering a load.

7. A pressure switch construction as set forth in claim 6, wherein the actuator further includes a post with a bulbous shoulder being directly engagable with spring plate to cause pivoting movement thereof.

8. A pressure switch construction as set forth in claim 6, a movable pillar carried by said housing and being disposed between and engageable with the spring plate and the actuator to carry the spring compression of the first and second springs to restrain the pivoting movement of the spring plate until a predetermined pressure is applied to the actuator equaling the desired trip point of the pressure switch to activate a sump pump.

* * * * *